US009375632B1

(12) United States Patent
Kish et al.

(10) Patent No.: US 9,375,632 B1
(45) Date of Patent: Jun. 28, 2016

(54) SKATEBOARD

(71) Applicants: Michael Kish, Granger, IN (US); Ryan Scott Miller, Indianapolis, IN (US)

(72) Inventors: Michael Kish, Granger, IN (US); Ryan Scott Miller, Indianapolis, IN (US)

( * ) Notice: Subject to any disclaimer, the term of this patent is extended or adjusted under 35 U.S.C. 154(b) by 0 days.

(21) Appl. No.: 14/695,574

(22) Filed: Apr. 24, 2015

Related U.S. Application Data

(60) Provisional application No. 61/991,136, filed on May 9, 2014.

(51) Int. Cl.
*A63C 17/01* (2006.01)
*A63C 17/26* (2006.01)

(52) U.S. Cl.
CPC ..... *A63C 17/012* (2013.01); *A63C 17/015* (2013.01); *A63C 17/26* (2013.01)

(58) Field of Classification Search
CPC .... A63C 17/01; A63C 17/011; A63C 17/012; A63C 17/02; A63C 17/002; A63C 17/0013; A63C 17/0006; A63C 17/017; A63C 17/0046; A63C 17/015; A63C 17/26; A63C 2203/42; A63C 2203/46
USPC ..... 280/87.042
See application file for complete search history.

(56) References Cited

U.S. PATENT DOCUMENTS

| | | | | |
|---|---|---|---|---|
| 8,469,569 | B1 * | 6/2013 | Tunnicliffe | A63C 17/015 280/87.042 |
| 2003/0155733 | A1 * | 8/2003 | Tan | A63C 17/01 280/87.042 |
| 2003/0155734 | A1 * | 8/2003 | Leslie | A63C 17/01 280/87.042 |
| 2004/0061300 | A1 * | 4/2004 | Grossman | A63C 17/0046 280/87.042 |
| 2005/0206109 | A1 * | 9/2005 | Mash | A63C 5/075 280/87.042 |
| 2007/0052190 | A1 * | 3/2007 | Forsberg | A63C 17/0046 280/87.042 |
| 2007/0170677 | A1 * | 7/2007 | Wake | A63C 17/0046 280/87.042 |
| 2011/0042913 | A1 * | 2/2011 | Landau | A63C 17/0046 280/87.042 |
| 2011/0079976 | A1 * | 4/2011 | Seip | A63C 17/0046 280/87.042 |
| 2014/0027192 | A1 * | 1/2014 | King | A63C 17/12 180/181 |
| 2014/0197611 | A1 * | 7/2014 | Lai | B62M 1/00 280/87.042 |
| 2015/0238845 | A1 * | 8/2015 | Clayton | B62K 3/002 280/87.042 |

* cited by examiner

*Primary Examiner* — John Walters
*Assistant Examiner* — Brian Swenson
(74) *Attorney, Agent, or Firm* — Faegre Baker Daniels, LLP

(57) ABSTRACT

A skateboard including a pair of trucks, a plurality of wheels mounted on axles of the trucks, a frame assembly, and a board mounted and attached to the frame assembly. The trucks can be mounted to the frame assembly and board.

16 Claims, 13 Drawing Sheets

SKATEBOARD

This application is a non-provisional application claiming priority from U.S. Provisional Patent Application Ser. No. 61/991,136, filed on May 9, 2014, the entirety of which is incorporated by reference herein.

BACKGROUND OF THE INVENTION

The subject invention relates to a skateboard, and in particular, to a skateboard including distinct board and frame elements.

Skateboarding has been a popular form of recreation over many years. Furthermore, skateboarding has progressed to the point where elaborate tricks and competitions have revolutionized skateboarding. Nonetheless, skateboards have fundamentally changed little since the inception. The main improvements have related to the wheels, bearings and wheel mounting assemblies (or trucks) to which the wheels are mounted to the board; however, the boards themselves have changed little. Most boards are still either one piece wood, wood laminate, or of a polymer composition.

The present invention provides a significant advancement in skateboard technology and design by incorporating distinct board and frame assemblies to which the wheels and trucks are mounted.

SUMMARY OF THE INVENTION

In one embodiment of the invention, a skateboard is provided that includes a pair of trucks, a plurality of wheels mounted on axles of the trucks, a frame assembly, and a board, mounted and attached to the frame assembly. The trucks can be mounted to the frame assembly and/or board.

The frame assembly may include top plates mounted to extensions on the board. The frame assembly may be narrower at front and rear ends thereof where the trucks are mounted and wider in a central portion thereof.

The frame assembly may include a bottom plate, a pair of truss members, and at least one cross member extending between the truss members. The bottom plate may be curved and higher at the ends where the trucks are attached and lower in the middle of the skateboard. The truss members may be located closer to one another at the ends of the skateboard than in the middle of the skateboard.

The bottom plate of the frame assembly may include a central generally rectangular portion, a pair of triangular portions connected to and extending from opposite sides of the rectangular portion, and extensions extending from the small ends of the triangular portions opposite the ends connected to the rectangular portion. The generally rectangular portion may include a multiplicity of slots, and tabs extend from the triangular portions and the extensions.

The truss members may include slots extending therethrough in a middle region and towards ends of the truss members and a tab extending downwardly therefrom. The cross member may include tabs extending from ends thereof and another tab extending downwardly from a side thereof. The tabs extending outwardly from the bottom plate can be received in respective slots in the truss members, and the tab extending downwardly from each truss member can be received in respective slots in the generally rectangular portion of the bottom plate.

The tabs in the ends of the cross-member can be received in respective slots in the truss members, and the tab extending downwardly from a side of the cross-member can be received in one of the slots in the generally rectangular portion of the bottom plate.

The board of the may be comprised of a transparent or translucent material and graphics can be mounted on at least one side of the board.

In another aspect of the invention, a skateboard is provided that includes a pair of trucks; a plurality of wheels mounted on axles of the trucks; a frame assembly including extensions; top plates; and a board having ends thereof sandwiched between respective top plates and the extensions.

The board may include a transparent or translucent material. The skateboard may include graphics mounted on at least one side of the board. The graphics may include at least a portion that is transparent or translucent, allowing the frame assembly to be visible through the board from a top side.

The graphics may alternately be mounted on both sides of the board, and a portion of the graphics on a top side of the board is visible or translucent, allowing the graphics to be seen on the bottom side of the board by viewing from the top side.

The frame assembly of the skateboard may be narrower at front and rear ends thereof, where the trucks are mounted and wider at a central portion thereof. The frame assembly may also include a bottom plate that is curved and higher at ends where the trucks are attached and lower in a middle portion of the skateboard.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
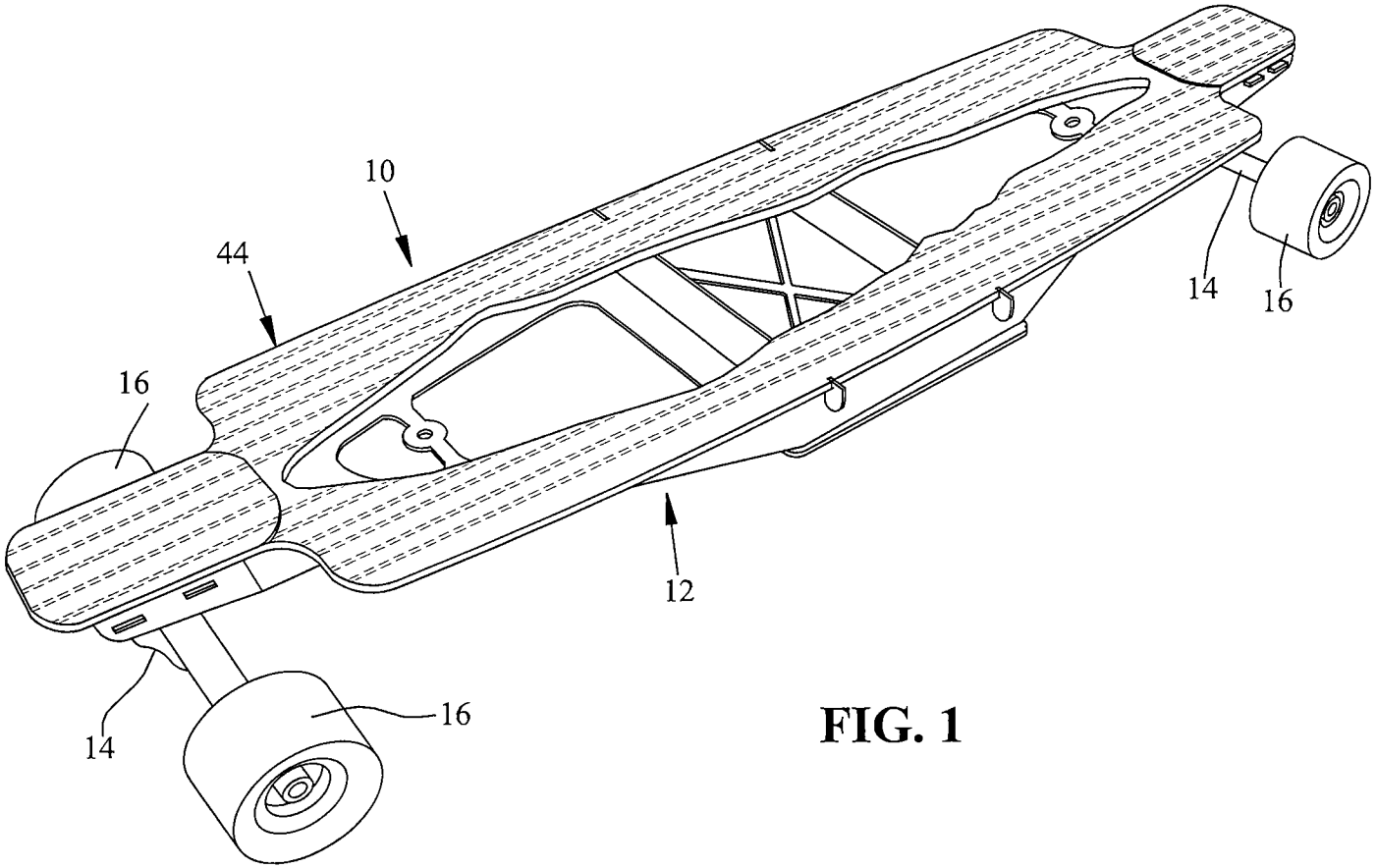
FIG. 1 is a perspective view of one embodiment of a skateboard in accordance with the subject invention.
Figure 2:
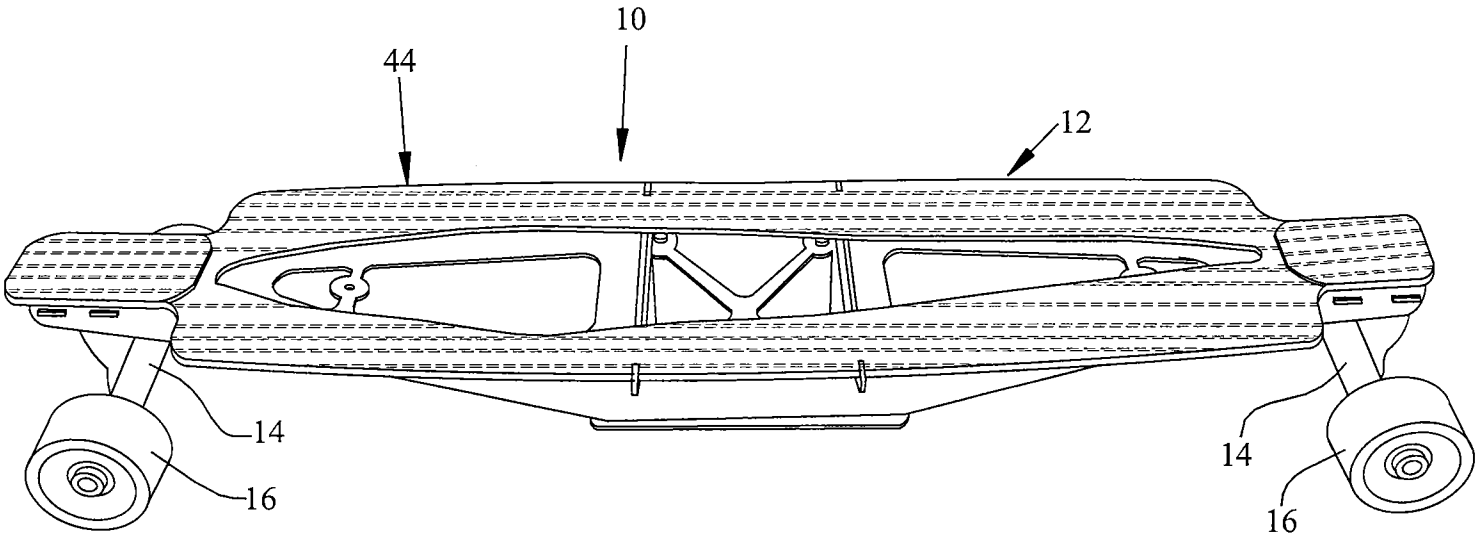
FIG. 2 is a side perspective view of the skateboard of FIG. 1.
Figure 3:
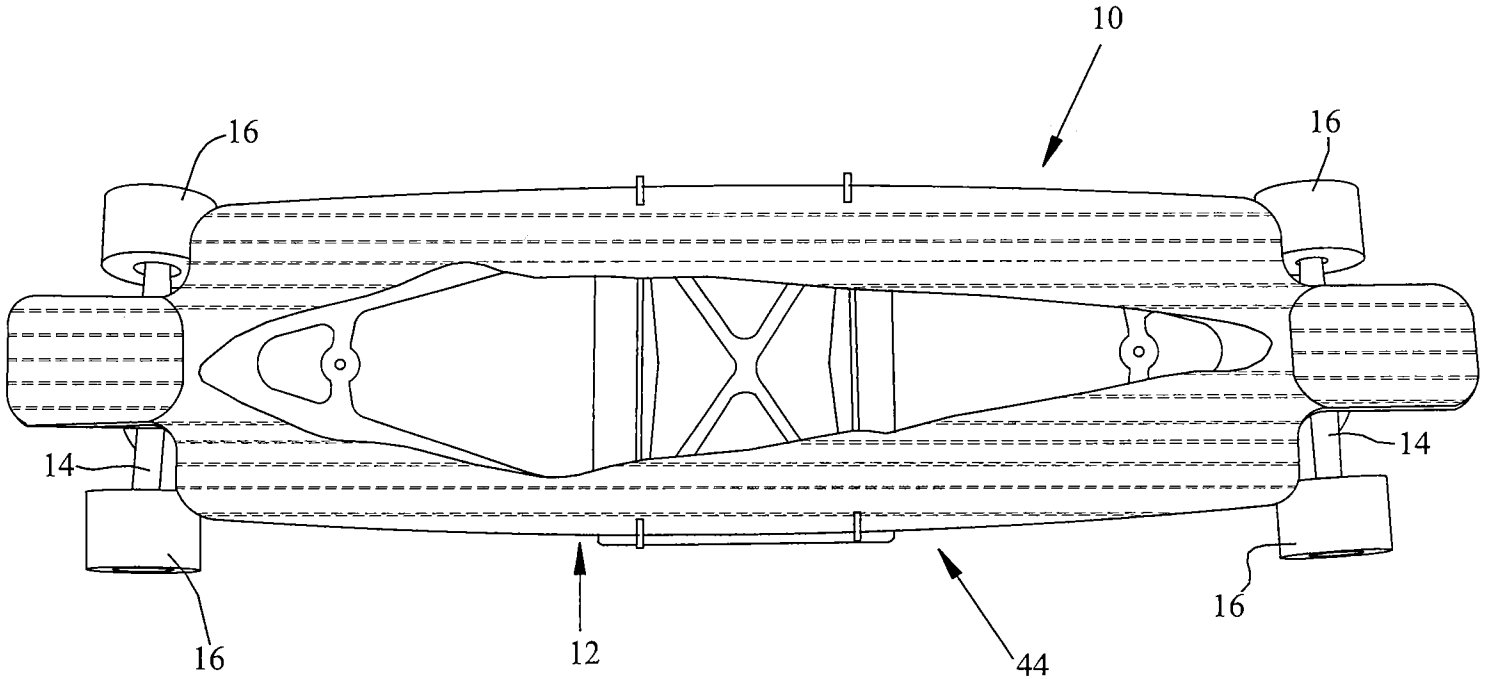
FIG. 3 is a top plan view of the skateboard of FIG. 1.
Figure 4:
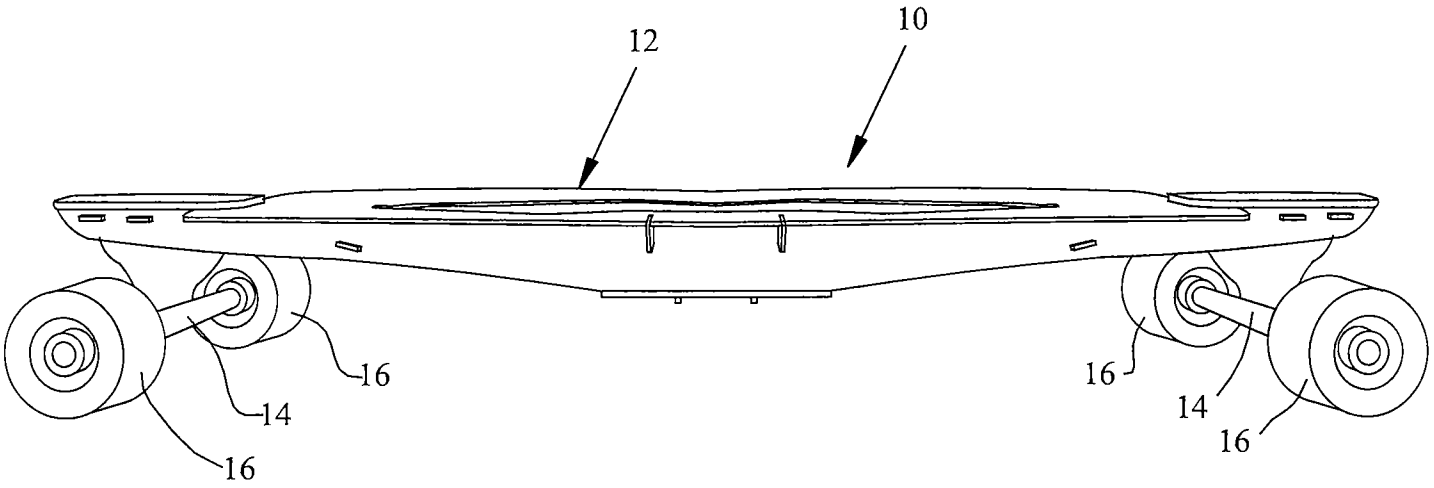
FIG. 4 is a side view of the skateboard of FIG. 1.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 5:
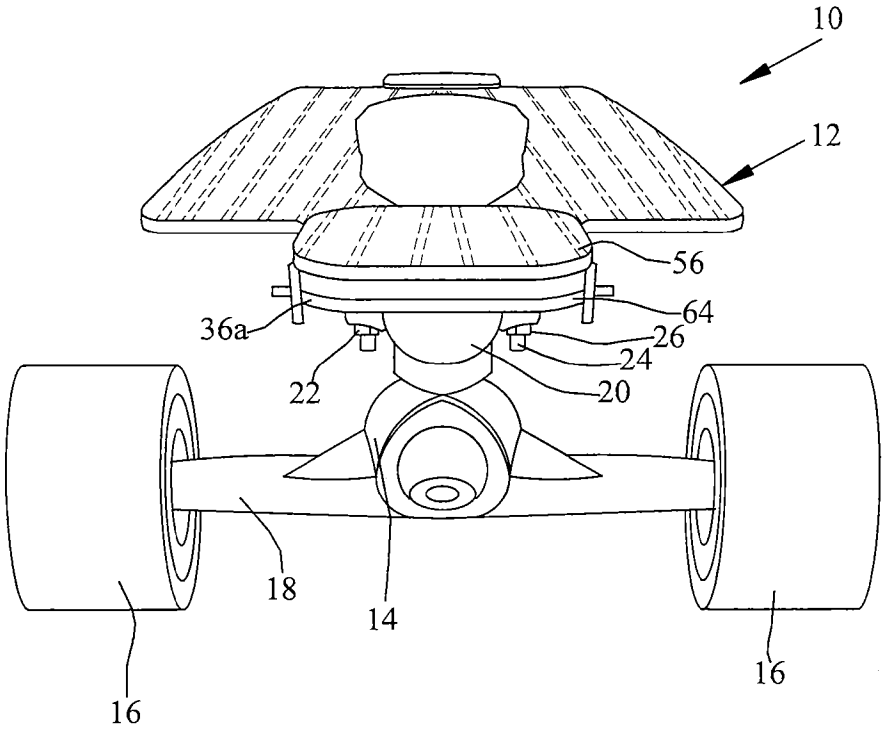
FIG. 5 is an end view of the skateboard of FIG. 1.

Referring now to FIGS. 1-8, one embodiment of a skateboard in accordance with the subject invention is shown generally indicated as 10. Skateboard 10 includes a body assembly generally indicated as 12. Skateboard 10 further includes a pair of trucks 14 and a pair of wheels 16 mounted on axles of each truck 14. Trucks 14 and wheels 16 may be a variety, which are well known to a person skilled in the art and currently used on existing skateboards. As best shown in FIG. 5, trucks 14 include an axle 18 and a trundle 20, which is used to mount trucks 14 to body assembly 12, using fasteners 22, or other known means of attachment. In the embodiment shown, fasteners 22 include bolts or screws 24 and nuts 26.

Figure 8:
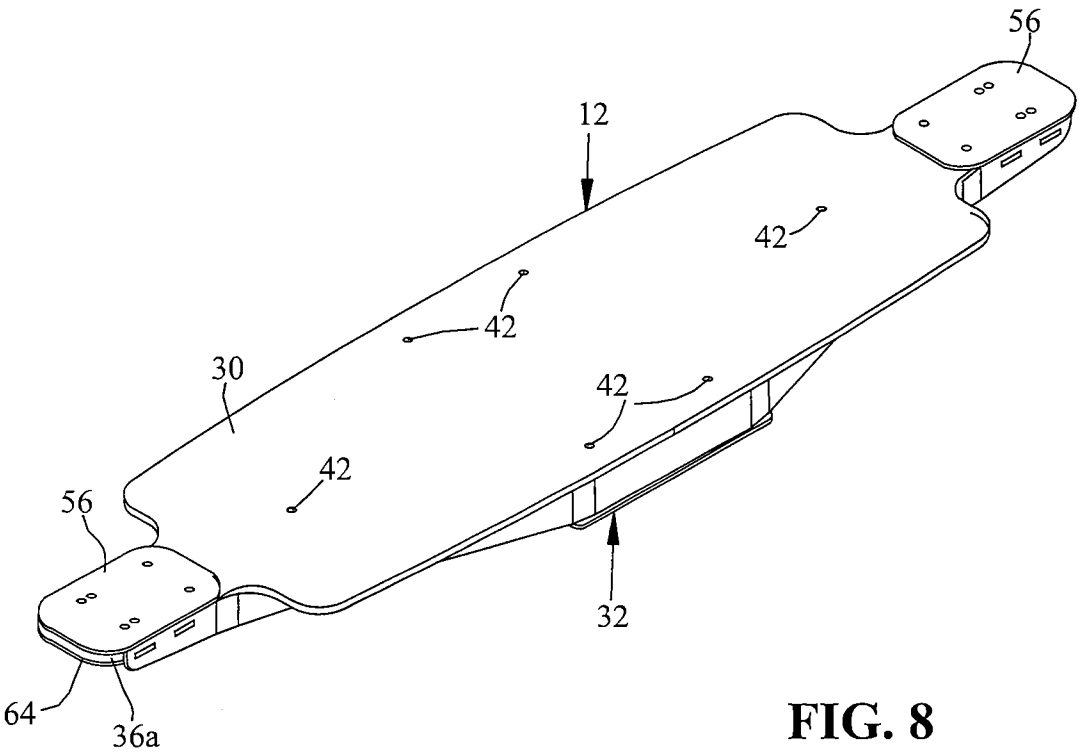
FIG. 8 is a perspective view of the skateboard of FIG. 1 with the wheels and trucks removed.
Figure 9:
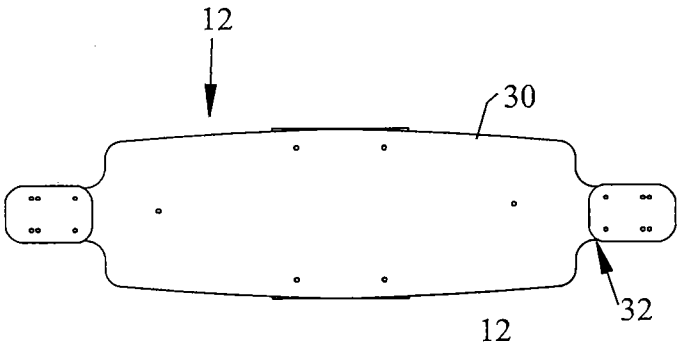
FIG. 9 is a top plan view of the skateboard in accordance with FIG. 8.
Figure 10:
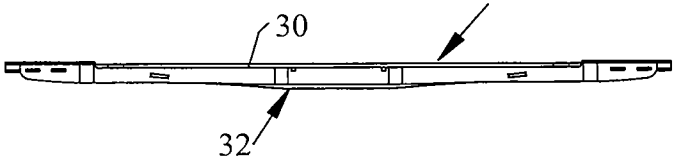
FIG. 10 is a side view of the skateboard in accordance with FIG. 8.
Figure 11:
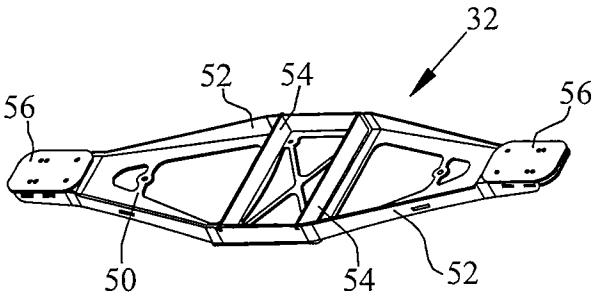
FIG. 11 is a perspective view of a frame assembly for the skateboard of FIG. 1.
Figure 12:
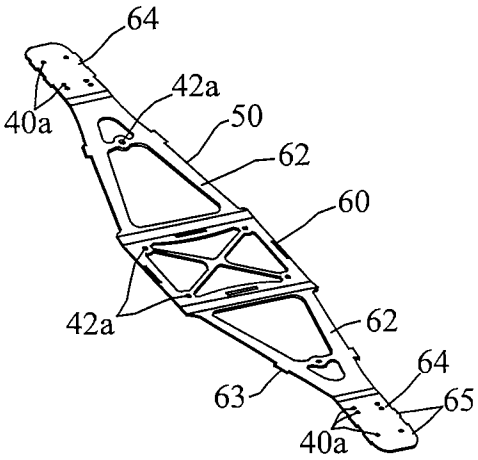
FIG. 12 is a perspective view of a bottom plate of the frame assembly of FIG. 11.
Figure 14:
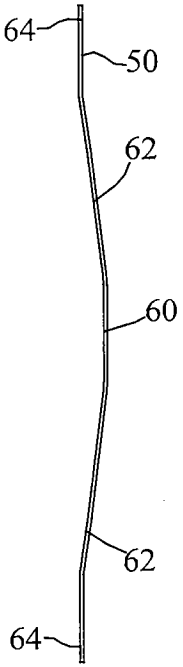
FIG. 14 is a side view of the bottom plate of the frame assembly of FIG. 11.
Figure 13:
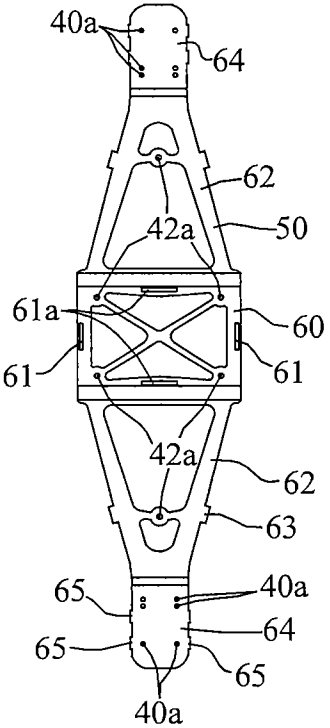
FIG. 13 is a plan view of the bottom plate of the frame assembly of FIG. 11.

Now referring to FIGS. 8-10, body assembly 12 includes a board 30 and a frame assembly generally indicated as 32. Board 30 has a generally rectangular configuration, and the embodiment shown has rounded or radiused corners 34. Additionally, board 30 includes tongues or extensions 36*a*, 36*b* extending longitudinally along the central axis and from each of ends 38 of board 30. Extensions 36*a* and 36*b* are used to mount trucks 14 and frame assembly 32 to board 30. Extensions 36*a* and 36*b* also include through holes 40 for receiving the fasteners 22 for securing the frame assembly 32 and trucks 14 to board 30. Board 30 includes an additional plurality of holes 42 to provide additional securing points of board 30 to frame assembly 32. It should be appreciated that the exact number of holes 40 and 42, and their corresponding location may be varied according to design, and stress needs.

In one embodiment, board 30 is fabricated from a polycarbonate material. Polycarbonate material offers the advantage of having approximately the same weight as wood and provides excellent strength and appropriate flexibility, but also offers the unique and inventive advantage of being able to utilize graphics, generally indicated by 44, and a see-through portion 44*a*, as best shown in FIGS. 1-3 and 5. This offers a significant advantage over opaque boards, which typically only include a non-slip surface or applique on the upper portion thereof. Graphics have been limited to edges or undersides of such prior boards. On the embodiment shown, the top may include solid graphics covering the entire board or partially clear graphics as shown in FIGS. 1-3 and 5, that allow the framework to be seen from above. Clear boards also provide the ability to use double vinyl graphics, which can include two sets of graphics, adhered together in a back-to-back manner so that one set of the graphics is visible from the side of the board, which the graphics are attached, and the other set of the graphics is visible through the board. This unique design also offers the advantage to allow customers to design their own graphics on a website or otherwise to have a custom graphic board. Note, the present invention is not limited to polycarbonate boards although such composition offers the advantages listed above. The unique frame assembly and board design may also be utilized with standard wood boards, wood laminates, other polymers, metal boards, or composites including carbon and/or fiberglass.

Now referring to FIGS. 11-21, in the embodiment shown, frame assembly 32 includes a bottom plate 50, a pair of bottom truss members 52, a pair of lower cross members 54, and a pair of top plates 56. Frame assembly 32 may be manufactured from a suitable metal, such as aluminum, which offers the advantage of both strength and lightweight, but may also be made of other suitable materials such as polymers, composites or even wood construction. In the embodiment shown, plate 50 may be machined or stamped from a single sheet of material and includes a central rectangular portion 60, having slots 61 and 61*a*, a pair of generally triangular areas or portions 62, extending from central portion 60. Tabs 63 extend outwardly from triangular areas 62, and a pair of extensions 64 extend from the small ends of the generally triangular portions 62. Extension 64 have tabs 65 extending from the sides thereof. Bottom plate 50 also includes holes 40*a* and 42*a* that are aligned with holes 40 and 42 in board 30, respectively.

Figure 6:
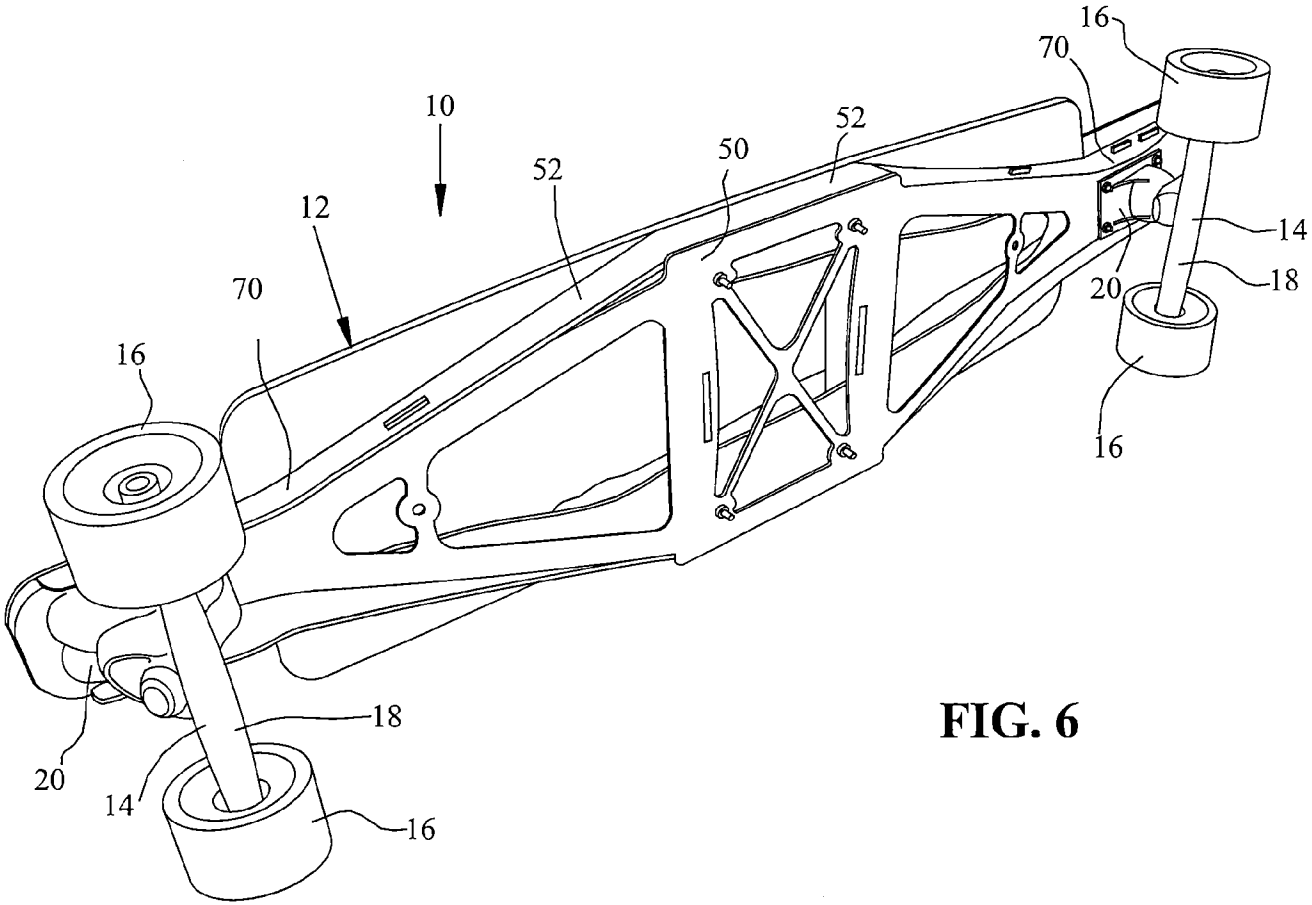
FIG. 6 is a bottom perspective view of the skateboard of FIG. 1.
Figure 7:
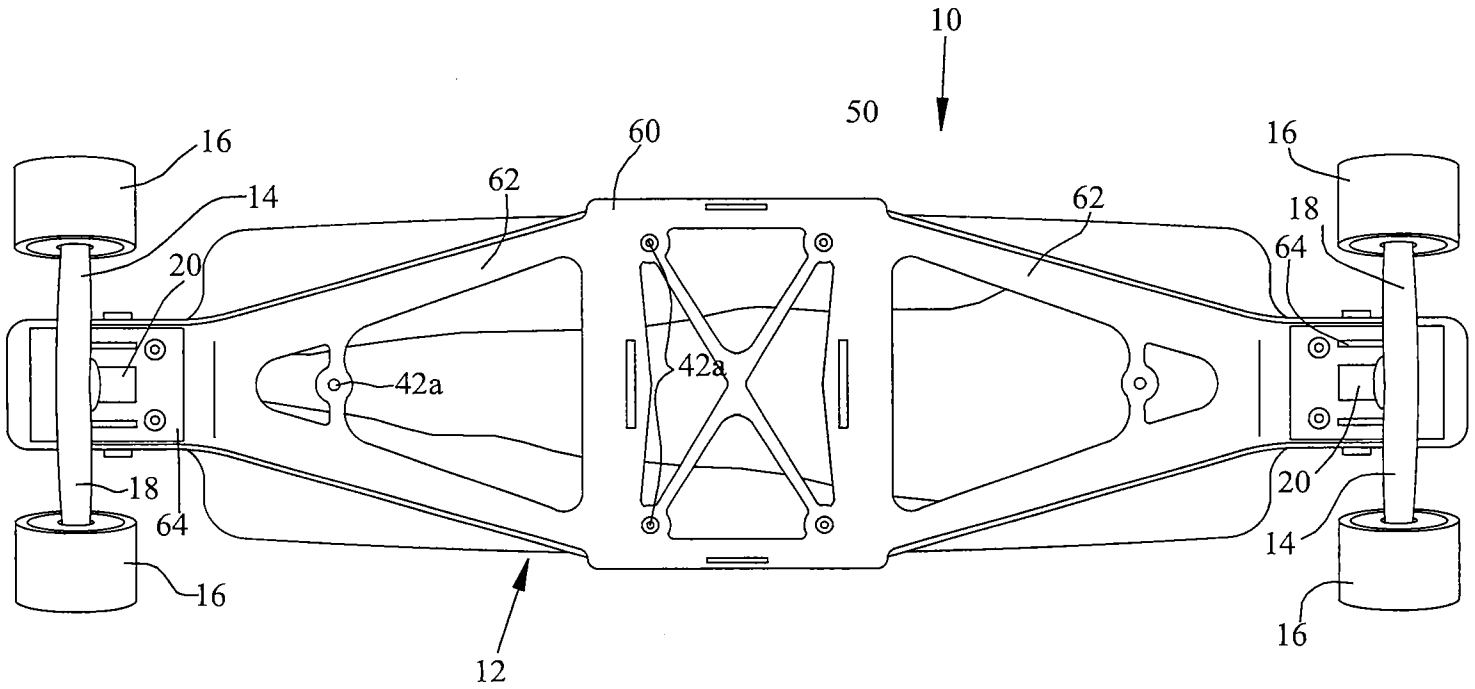
FIG. 7 is a bottom plan view of the skateboard of FIG. 1.
Figure 15:
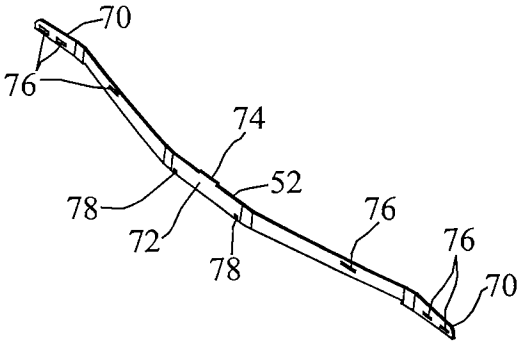
FIG. 15 is a perspective view of one bottom truss of the frame assembly of FIG. 11.
Figure 16:
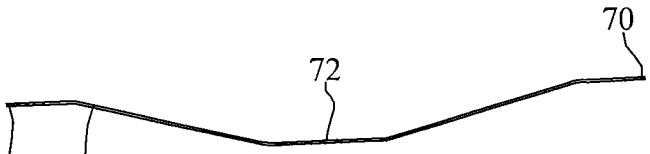
FIG. 16 is a top plan view of the bottom truss of FIG. 15.
Figure 17:
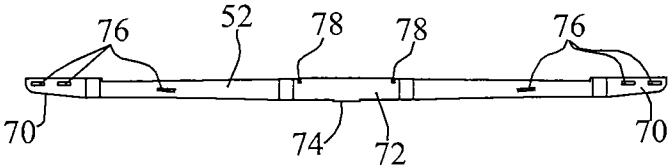
FIG. 17 is a side view of the bottom truss of FIG. 15.

Now referring to FIGS. 15-17, details of one embodiment of the bottom truss members 52 are depicted. Truss numbers 52 may be formed from a single piece of material, and in the embodiment shown have a bowed configuration as best shown in FIGS. 15 and 16. When assembled, outer ends 70 of the truss members will be bowed in towards one another, and located closer to one another than a central portion 72 as best shown in FIG. 6. Truss members 52 also include a tab 74 extending down from the middle thereof for receipt in slots 61 of bottom plate 50 and a plurality of slots 76 for receipt of tabs 63 and 65 on bottom plate 50. Slots 78 are also provided in top edges of truss members 52 for receipt of tabs of the cross members. It should be appreciated when tabs 63, 65, and 74 are inserted into respective slots, the tabs may be long enough to be bent or have sufficient thickness to hold frame assembly together or the tabs may be welded into the slots. Alternately, the tabs and slots may be left off and the parts only welded to one another. Also, if a polymer is used, the frame may be molded as a single piece.

Figure 18:
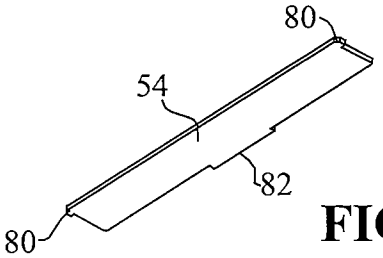
FIG. 18 is a perspective view of a lower cross member for the frame assembly of FIG. 11.
Figure 19:
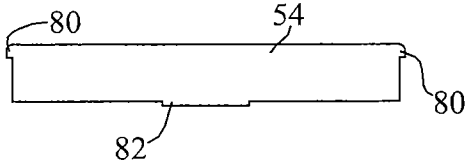
FIG. 19 is a side view of the lower cross member of FIG. 18.

Now referring to FIGS. 18 and 19, one embodiment for cross members 54 is shown. Cross members 54 have a generally rectangular configuration that includes a pair of tabs 80 extending from upper side ends thereof for receipt in slots 78 of truss members 52. Cross members 54 also include a tab 82 extending downward from a general central portion of the lower end for receipt in slots 61*a* of bottom plate 50.

Figure 20:
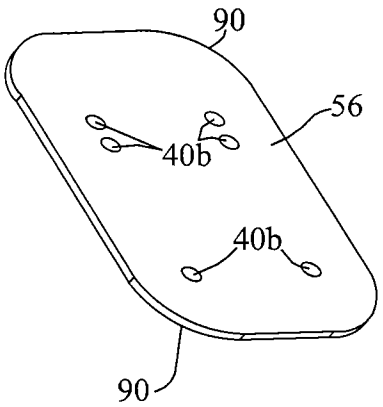
FIG. 20 is a perspective view of one top plate of the frame assembly of FIG. 11.
Figure 21:
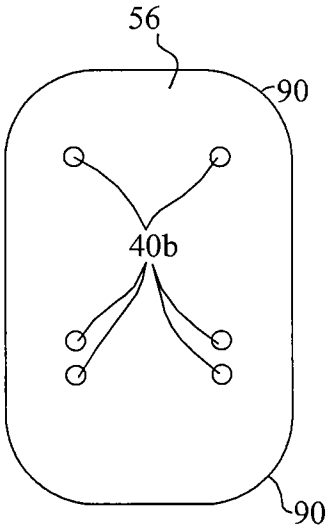
FIG. 21 is a top plan view of the top plate of FIG. 20.
Figure 22:
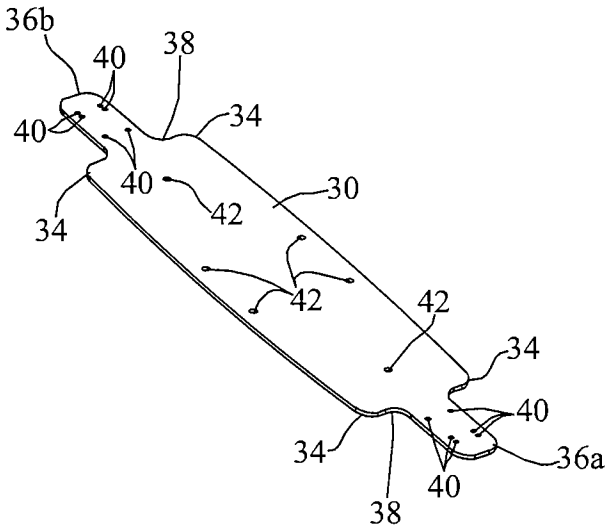
FIG. 22 is a perspective view of a board for the skateboard of FIG. 1.
Figure 23:
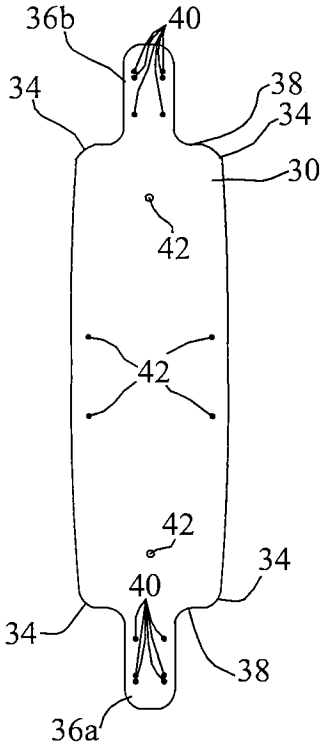
FIG. 23 is a top plan view of the board of FIG. 22.

Now referring to FIGS. 20 and 21, one embodiment for top plates 56 is depicted. Top plate 56 has a generally rectangular configuration with rounded corners 90, which generally align and coincide with extensions 36*a*, 36*b* of board 30 and extensions 64 of top plate 50 when assembled, as best shown in FIGS. 5 and 8. Top plates 56 also include a plurality of holes

40*b*, which are aligned with holes 40*a* in extension 64 of bottom plate 50 and holes 40 in extensions 36*a*, and 36*b* of board 30.

To assemble skateboard 10, frame assembly 32 may be assembled first as noted above by inserting corresponding slots and tabs of bottom plate 50, truss members 52 and cross members 54 in respective tab and slot combinations. Also, as previously noted, the tabs may be bent or press fit into the slots or alternately the tabs may be welded in slots, or alternately all or some of the tabs and slots eliminated so that bottom plate 50, truss members 52 and cross members 54 are simply welded together. As noted above, the frame assembly may also be machined from a single piece or molded as a single unit.

Next, frame assembly 32 can be attached to board 30 and trucks 14. As best seen in FIGS. 5 and 8, extensions 36*a* and 36*b* of boards 30 are sandwiched in between top plates 56 and extensions 64 of bottom plates 50. Trucks are mounted to the bottom of extension 64 and the assembly is held together with fasteners 22. Heads of bolts or screws 24 of fasteners 22 may be countersunk into holes 40*b* of top plates 56 or alternately the bolts may be welded or press fit into the top plate. Additional fasteners 22 may be used to provide central securing/attachment through holes 42 of board 32, and holes 42*a* of frame assembly 32.

While the invention has been taught with specific reference to these embodiments, one skilled in the art will recognize that changes can be made in form and detail without departing from the spirit and scope of the invention. For example, although the embodiment depicted shows distinct extensions extending from the board for mounting to the frame assembly and attachment of the trucks, alternate shapes may be suitable such as wherein the extensions are tapered from the board or the extensions are merely integral with a generally rectangular configuration of the board. Additionally, although the frame depicted has a generally rectangular central portion with triangular portions or sections extending outwardly therefrom and extensions attached to the triangular portions, the frame may also be more rounded or generally more rectangular or other suitable configurations for the board or frame may be employed. Therefore, the described embodiments are to be considered, therefore, in all respects only as illustrative and not restrictive. As such, the scope of the invention is indicated by the following claims rather than by the description.

The invention claimed is:

1. A skateboard including:

a pair of trucks;

a plurality of wheels mounted on axles of the trucks;

a frame assembly, the frame assembly being narrower at front and rear ends thereof where the trucks are mounted and wider in a central portion thereof, and the frame assembly includes a bottom plate, a pair of truss members, and at least one cross member extending between the truss members, the bottom plate is curved and is higher at ends thereof where the trucks are attached and lower in a middle portion of the skateboard; and a board mounted and attached to the frame assembly, the trucks being mounted to the frame assembly and board.

2. The skateboard as set forth in claim 1, wherein the frame assembly includes a top plate mounted over extensions on the board.

3. The skateboard as set forth in claim 1, wherein the truss members are located closer to one another at the ends of the skateboard than in the middle portion of the skateboard.

4. The skateboard as set forth in claim 1, wherein the board is comprised of a transparent or translucent material and graphics are mounted on at least one side of the board.

5. A skateboard including:

a pair of trucks;

a plurality of wheels mounted on axles of the trucks;

a frame assembly, the frame assembly being narrower at front and rear ends thereof where the trucks are mounted and wider in a central portion thereof, the frame assembly including a bottom plate, a pair of truss members, and at least one cross member extending between the truss members;

and a board mounted and attached to the frame assembly, the trucks being mounted to the frame assembly and board, and, wherein the bottom plate of the frame assembly includes a central generally rectangular portion, a pair of triangular portions connected to and extending from opposite sides of the rectangular portion, and extensions extending from small ends of the triangular portions opposite the ends connected to the rectangular portion.

6. The skateboard as set forth in claim 5, wherein the generally rectangular portion includes a multiplicity of slots, and tabs extend from the triangular portions and the extensions.

7. The skateboard as set forth in claim 6, wherein the truss members include slots extending therethrough in a middle region and towards ends of the truss members and a tab extending downwardly therefrom.

8. The skateboard as set forth in claim 7, wherein the cross member includes tabs extending from ends thereof, and another tab extending downwardly from a side thereof.

9. The skateboard as set forth in claim 8, wherein the tabs extending outwardly from the bottom plate are received in respective slots in the truss members, and the tab extending downwardly from each truss member is received in respective slots in the generally rectangular portion of the bottom plate.

10. The skateboard as set forth in claim 9, wherein the tabs in the ends of the cross-member are received in respective slots in the truss members, and the tab extending downwardly from a side of the cross-member is received in one of the slots in the generally rectangular portion of the bottom plate.

11. A skateboard including:

a pair of trucks;

a plurality of wheels mounted on axles of the trucks;

a frame assembly including extensions, the frame assembly being narrower at front and rear ends thereof where the trucks are mounted and wider at a central portion thereof, and the frame assembly including a pair of truss members extending substantially along an entire length of the board, said truss members being spaced apart farther in the central portion from one another, than at the front and rear ends;

top plates; and a board having ends thereof sandwiched between respective top plates and the extensions.

12. The skateboard as set forth in claim 11, wherein the board is comprised of a transparent or translucent material.

13. The skateboard as set forth in claim 12, including graphics mounted on at least one side of the board.

14. The skateboard as set forth in claim 13, wherein the graphics include at least a portion that is transparent or translucent, allowing the frame assembly to be visible through the board from a top side.

15. The skateboard as set forth in claim 13, including graphics mounted on both sides of the board, and a portion of the graphics on a top side of the board is visible or translucent, allowing the graphics to be seen on the bottom side of the board by viewing from the top side.

16. The skateboard as set forth in claim 11, wherein the frame assembly includes a bottom plate that is curved and higher at ends where the trucks are attached and lower in a middle portion of the skateboard.

* * * * *